US006832656B2

(12) United States Patent
Fournier, Jr. et al.

(10) Patent No.: US 6,832,656 B2
(45) Date of Patent: Dec. 21, 2004

(54) VALVE FOR AN INTERNAL FILL UP TOOL AND ASSOCIATED METHOD

(75) Inventors: Steve W. Fournier, Jr., Lafayette, LA (US); Doyle F. Boutwell, Jr., Houston, TX (US)

(73) Assignee: Weartherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/180,890

(22) Filed: Jun. 26, 2002

(65) Prior Publication Data

US 2004/0000405 A1 Jan. 1, 2004

(51) Int. Cl.[7] ..... E21B 34/08; E21B 34/12

(52) U.S. Cl. ..... 166/373; 166/386; 166/332.3; 137/68.23; 137/614.18

(58) Field of Search ..... 166/373, 386, 166/317, 332.3, 326; 251/315.01, 315.06; 137/68.23, 614.17, 614.18

(56) References Cited

U.S. PATENT DOCUMENTS

| | | | | | |
|---|---|---|---|---|---|
| RE19,087 | E | * | 2/1934 | Minor | 137/68.23 |
| 3,404,698 | A | * | 10/1968 | Rouse | 137/68.23 |
| 3,481,397 | A | | 12/1969 | Baker | 166/225 |
| 4,158,369 | A | * | 6/1979 | Storzinger et al. | 137/599.18 |
| 4,317,486 | A | * | 3/1982 | Harris | 166/250.04 |
| 4,474,241 | A | | 10/1984 | Freeman | 166/317 |
| 5,501,280 | A | | 3/1996 | Brisco | 166/373 |
| 5,682,952 | A | | 11/1997 | Stokley | 166/373 |
| 5,918,670 | A | * | 7/1999 | Coutts et al. | 166/75.11 |
| 5,944,051 | A | * | 8/1999 | Johnson | 137/559 |
| 5,971,079 | A | | 10/1999 | Mullins | 166/387 |
| 5,992,520 | A | * | 11/1999 | Schultz et al. | 166/264 |
| 6,125,930 | A | * | 10/2000 | Moyes | 166/66 |
| 6,173,777 | B1 | | 1/2001 | Mullins | 166/285 |
| 6,230,733 | B1 | * | 5/2001 | Strelow et al. | 137/68.23 |
| 6,302,216 | B1 | * | 10/2001 | Patel | 166/375 |
| 6,561,275 | B2 | * | 5/2003 | Glass et al. | 166/317 |
| 2002/0066564 | A1 | | 6/2002 | Mosing et al. | 166/285 |

OTHER PUBLICATIONS

PCT International Search Report, International Application No. PCT/US 03/19709, dated Oct. 10, 2003.

DraWorks, L.P., "Auto Valve For Casing Fill–Up, Circulating, & Flow Back," *Operating and Maintenance Manual.*

* cited by examiner

*Primary Examiner*—David Bagnell
*Assistant Examiner*—Shane Bomar
(74) *Attorney, Agent, or Firm*—Moser, Patterson & Sheridan, L.L.P.

(57) ABSTRACT

The present invention generally relates to a valve for use in an oilfield tool. The valve includes a valve body and a valve member disposed in the valve body. The valve member is movable between an open and closed position. The valve member includes an aperture therethrough. The valve further includes a pressure relief member disposed in the aperture, whereby at a predetermined pressure the pressure relief member will permit fluid communication. In another aspect, the invention provides an apparatus and a method for introducing fluid into a tubular.

21 Claims, 5 Drawing Sheets

VALVE FOR AN INTERNAL FILL UP TOOL AND ASSOCIATED METHOD

BACKGROUND OF THE INVENTION

1. Field of the Invention

The present invention relates to an apparatus and a method used in the completion of a well. More particularly, the invention relates to a casing fill-up and circulating tool. More particularly still, the present invention relates to a diaphragm ball valve for a casing fill-up and circulating tool.

2. Description of the Related Art

In the drilling of oil and gas wells, a wellbore is formed using a drill bit that is urged downwardly at a lower end of a drill string. After drilling the wellbore to a predetermined depth, the drill string and bit are removed. Thereafter, the wellbore is typically lined with a string of steel pipe called casing. The casing provides support to the wellbore and facilitates the isolation of certain areas of the wellbore adjacent hydrocarbon bearing formations.

During the run-in of a casing string, the string is typically filled with mud. The primary reason to fill the casing string with mud is to prevent the new string of casing from collapsing due to the pressure imbalances between the inside of the casing and the wellbore fluid therearound and avoidance of buoyancy. Typically, the filling process occurs as the casing string is assembled at the rig floor. A secondary reason to fill a casing string with mud is to use the mud to free a casing string when the casing becomes stuck during the run-in operation. In this situation, the drilling operator circulates mud down the casing to wash sand or other debris from the lowermost end of the casing, thereby freeing the stuck casing.

Typically, a fill-up and circulating tool is used in conjunction with a mud pump to fill and circulate the mud in the casing. An example of a fill-up and circulating tool is described in U.S. Pat. No. 6,173,777, which is incorporated herein by reference in its entirety. FIG. 1 illustrates a partial cross-sectional view of a fill-up and circulating tool 50 with a valve 60 in a closed position as shown in the '777 patent. The tool 50 is supported from a top drive (not shown) and includes a top sub 10 with an internal bore 12. The internal bore 12 is connected to a mud pump (not shown) through a hose (not shown) for filling and circulating a casing 14. The top sub 10 is connected to body 16 at thread 18. Tool 50 further includes a rotating sleeve 22 disposed on the upper portion of the body 16. A cup seal 20 is mounted to sleeve 22. The cup seal 20 is used to seal off the casing 14 when the tool 50 is operating. Additionally, a gage ring 38 is mounted on body 16 and secured in place by nut 34. The gage ring 38 positions the tool 50 in the center of the casing 14 to facilitate insertion of the tool 50 into the upper end of the casing 14.

As shown in FIG. 1, the body 16 is connected to the valve 60 through a tubular spacer 35. The valve 60 includes a valve member 41 (ball valve) that is movable between an open and closed position. The valve member 41 is disposed in a valve body 40. The valve member 41 is held in position within the valve body 40 by an upper valve seal 42, lower valve seal 43, and bottom sub 45. A valve stem 46 and an arm 44 are attached to valve member 41 to control the open/closed rotational position of the valve member 41. As shown, a gage ring 53 is disposed at the lower end of the valve body 40. The gage ring 53 centers the valve 60 in the casing and protects valve arm 44 during insertion of the valve 60 into the upper end of the casing 14. Centering of the valve 60 ensures that the arm 44 will rotate sufficiently to open the valve member 41. In the closed position, the arm 44 is rotationally limited by its contact with gage ring 53. The arm 44 is constructed and arranged of weighted material to open the valve member 41 only when the valve 60 is inserted into casing 14 and to close the valve member 41 after the valve is removed from the casing 14. The arm 44 is weighted such that upon removal, gravity causes the arm 44 to rotate downward, thereby providing rotational torque to close the valve member 41 as the valve 60 is removed from the casing 14.

FIG. 2 illustrates a partial cross-sectional view of the prior art fill-up and circulating tool 50 with the valve 60 in an open position as shown in the '777 patent. As depicted, the valve 60 is fully inserted into the upper end of the casing 14. As the valve 50 is inserted, the bottom sub 45 will be positioned near the center of the casing 14 and gage ring 53 will further center the valve 60. At the same time, the valve arm 44 will be rotated by contact with the upper end of the casing 14. Rotating the valve arm 44 upwards opens valve member 41. In this position, a mud pump may be started to fill the casing 14. Fluid from the pump flows through the bore 12, through the fully opened valve member 41 and out ports 47 to fill the casing 14. After the casing 14 is filled, the mud pump is turned off and the tool 50 may be removed from the casing 14. Upon removal of the valve 60, gravity causes the weighted arm 44 to rotate downward, thereby rotating the valve member 41 to the closed position as shown on FIG. 1. In this manner, the casing 14 is filled with mud.

Generally, the mud pump is turned off while the fill-up and circulating tool is still in the casing, thereby allowing all the mud in the mud pump and the connecting hose to flow through the tool into the casing. However, a problem associated with the above referenced fill-up and circulating tool arises when the tool is suddenly or accidentally removed from the casing prior to shutting down of the mud pump. In this situation, a pressure surge is created in the tool due to the closed valve, thereby causing the mud pump to stop. This pressure surge may cause premature failure of the mud pump or other hydraulic components. Another problem arises after the casing is filled with mud. Typically, the tool is pulled out of the casing and the valve arm drops down to close the valve member. However, if the mud pump is not properly turned off to allow the mud in the in the connecting hose to exit the tool prior to removal of the tool from the casing, the volume of mud continues to enter the tool. Because the valve member is closed, the mud is prevented from exiting the tool. As a result, the pressure in the tool may become so large as to cause the hose to burst, thereby causing damage to the equipment or injury to personnel on the rig floor.

There is a need, therefore, for a valve that will prevent a pressure surge in the mud system when the tool is accidentally removed from the casing. There is a further need for a valve that will permit a volume of mud in the hose to exit the tool even though the valve is closed. There is yet a further need for a more reliable fill-up and circulating tool.

SUMMARY OF THE INVENTION

The present invention generally relates to a valve for use in an oilfield tool. The valve includes a valve body and a valve member disposed in the valve body. The valve member is movable between an open and closed position. The valve member includes an aperture therethrough. The valve further includes a pressure relief member disposed in the aperture, whereby at a predetermined pressure the pressure relief member will permit fluid communication.

In another aspect, the invention provides an apparatus to introduce fluid into a casing. The apparatus includes a body having a bore therethrough and a valve disposed in the body for selectively controlling a fluid flow through the bore. The valve includes a valve member movable between an open and closed position. The valve member includes an aperture for providing selective communication through the valve in a closed position. The valve further includes a pressure relief member disposed in the aperture, whereby at a predetermined pressure the pressure relief member will permit fluid communication.

Further, a method for introducing fluid into a tubular is provided. The method includes the step of locating an apparatus in the tubular. The apparatus includes a body having a bore therethrough and a valve disposed in the body for selectively controlling a flow fluid through the bore. The valve includes a valve member and a pressure relief member disposed in the valve member. The method further includes opening the valve in the apparatus, pumping fluid through the apparatus, and introducing fluid in to the tubular. The method also includes the step of removing the apparatus from the tubular.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
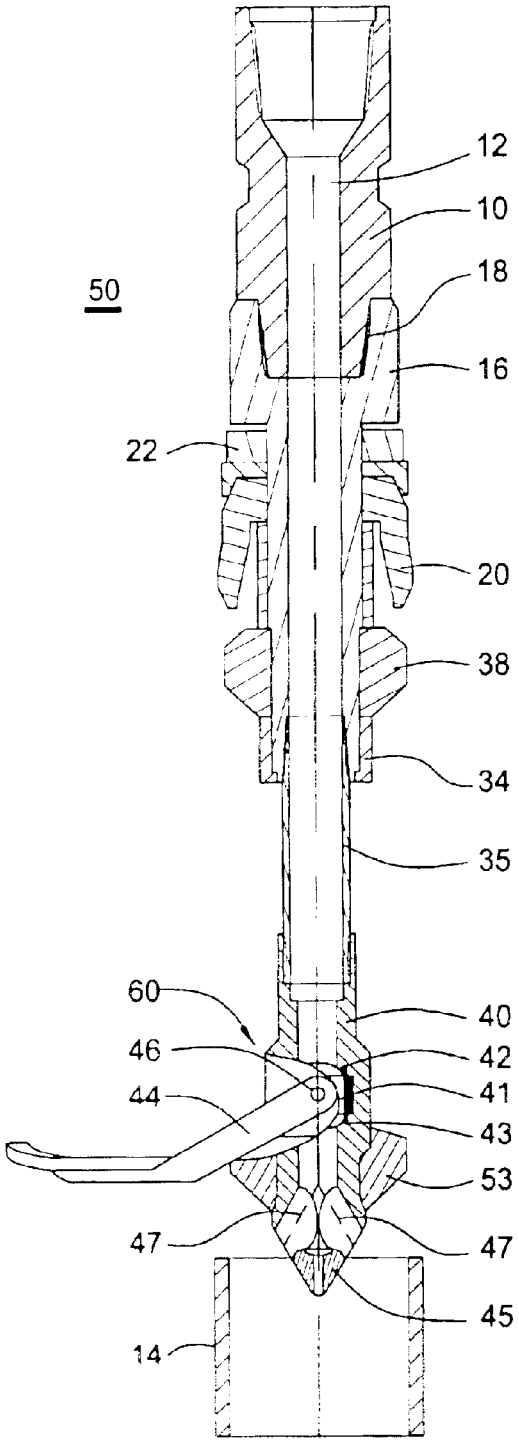
FIG. 1 (PRIOR ART)
FIG. 1 illustrates a partial cross-sectional view of the prior art fill-up and circulating tool of the '777 patent with a valve in a closed position.
Figure 2:
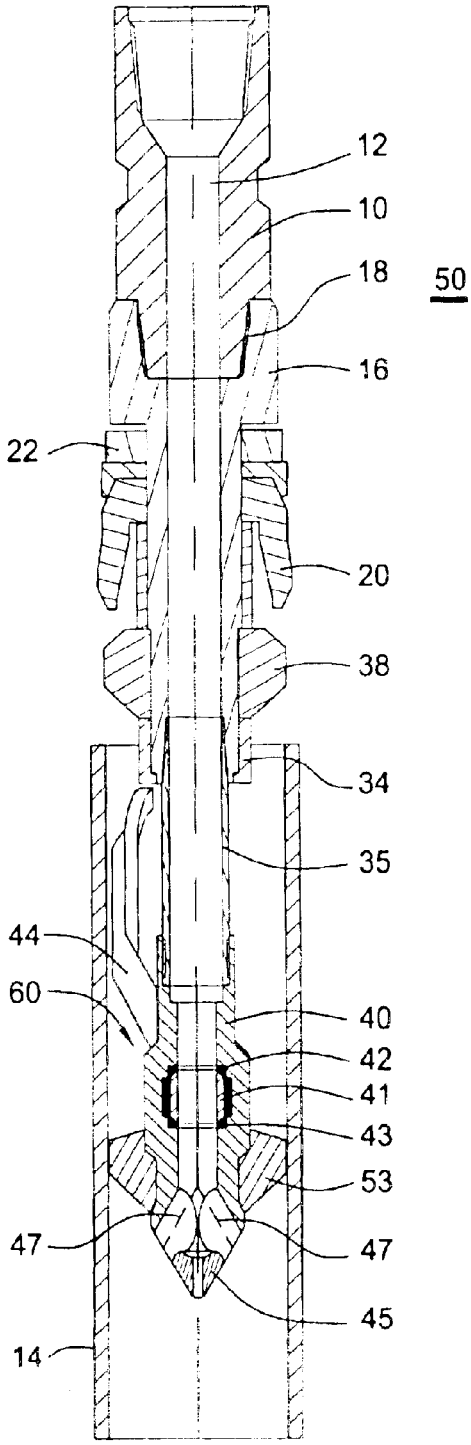
FIG. 2 (PRIOR ART)
FIG. 2 illustrates a partial cross-sectional view of the prior art fill-up and circulating tool of the '777 patent with the valve in an open position.
Figure 3:
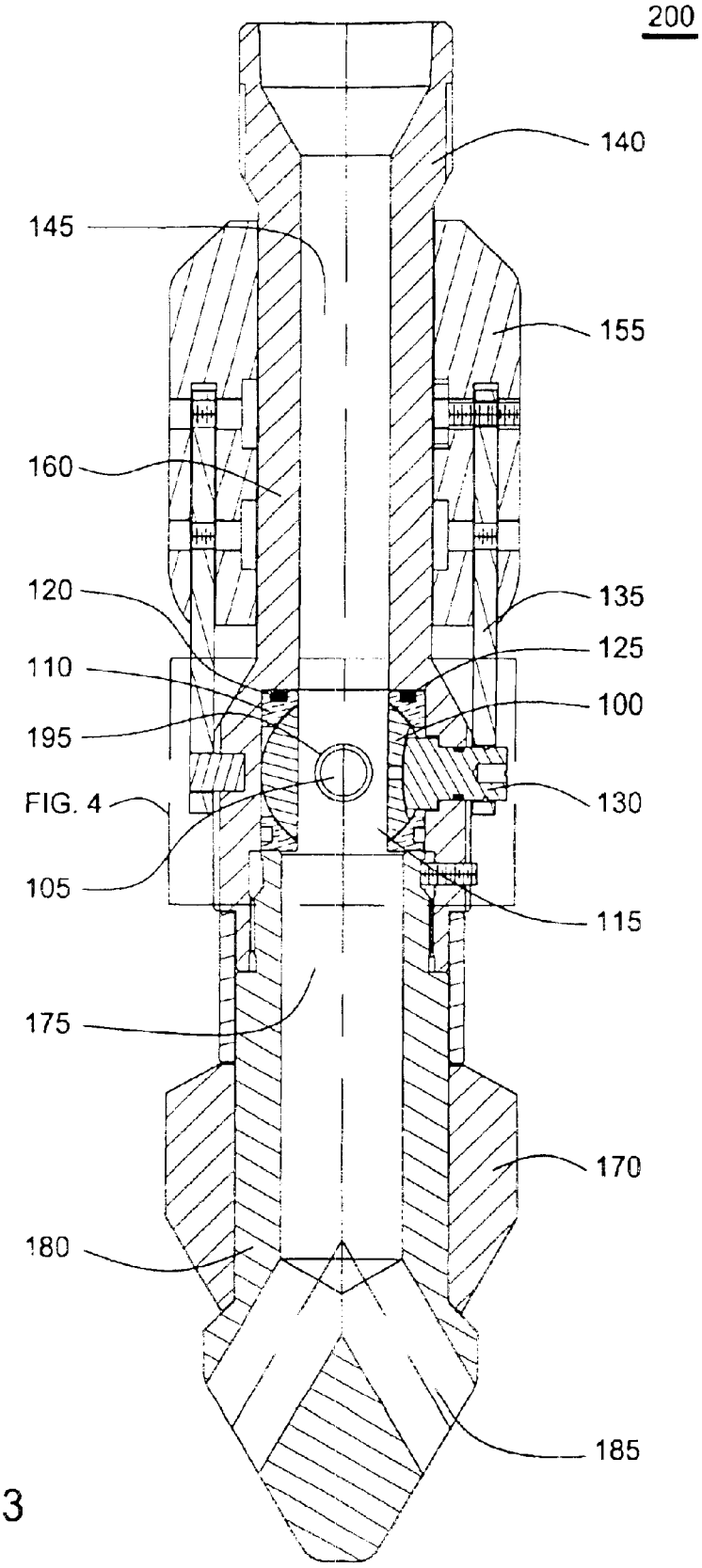
FIG. 3 illustrates a valve member of the present invention disposed in an oilfield tool.

FIG. 3 illustrates a valve member 100 of the present invention disposed in an oilfield tool. As illustrated, the oilfield tool is a fill-up and circulating tool 200. However, it should be noted that the valve member 100 may also be employed in other hydraulic oilfield tools that require a valve that will prevent premature failure of hydraulic components due to pressure surges and pressurization of the tool, thereby ensuring the safety of equipment and personnel.

As shown in FIG. 3, the tool 200 includes a body 160 that comprises of an upper body 140 and a lower body 180. The upper body 140 having an upper bore 145 to allow fluid communication through the tool 200. Typically, the top portion of the upper body 140 is connected to a mud pump (not shown). The mud pump is used for pumping the mud through the tool 200 into a casing string (not shown). The mud pump is typically connected to the tool 200 using a hydraulic hose (not shown).

As illustrated, the lower body 180 is disposed below the upper body 140. The lower body 180 contains a lower bore 175 in fluid communication with the upper bore 145. The lower bore 175 diverges into one or more ports 185 at the lower end of the body 180. Additionally, a gage ring 170 is disposed around the lower body 180 to center the tool 200 in the casing string.

As depicted on FIG. 3, the valve member 100 is disposed between the upper body 140 and lower body 180. The valve member 100 is housed in a valve body 110. The valve body 110 is connected to the lower end of the upper body 140. First and second seal members 120, 125 are disposed between the upper body 140 and the valve body 110. The first and second seal members 120, 125 form a sealing relationship between the upper body 140 and the valve body 110 to prevent fluid in the upper bore 145 from flowing around the valve body 110.

In the preferred embodiment, the valve member 100 is a standard ball valve. However, other forms of valve members may be employed, so long as they are capable of selectively permitting fluid flow through the tool 200. Additionally, in the preferred embodiment, the valve member 100 is constructed from stainless steel. However, the valve member 100 may also be constructed from other types of materials, such as composite material, so long as it is capable of withstanding a predetermined pressure and wellbore fluids that may be corrosive.

The valve member 100 is movable between an open and a closed position. Generally, the open position permits fluid to enter and exit the tool 200 while the closed position prevents fluid from exiting the tool 200 by sealing a valve bore 115. In the open position, the valve bore 115 in the valve member 100 aligns with the upper bore 145 and the lower bore 175, thereby allowing fluid communication through the tool 200. Conversely, in the closed position, the valve member 100 is rotated approximately 90 degrees. As a result, the valve bore 115 is out of alignment with the bores 145, 175, thereby preventing the flow of fluid through the valve bore 115. In this manner, the valve member 100 selectively controls fluid communication through the tool 200.

The valve member 100 further includes an aperture or a lateral bore 195 therethrough to act as a fluid conduit. A pressure relief member or a frangible disk member 105 is disposed in the lateral bore 195 to temporality prevent fluid communication through the lateral bore 195. As shown, the lateral bore 195 is located perpendicular to the valve bore 115. Therefore, as the valve member 100 is moved to the closed position, the lateral bore 115 aligns with the upper bore 145 and the lower bore 175. However, the presence of the frangible disk member 105 prevents fluid communication between the upper bore 145 and the lower bore 175.

The frangible disk member 105 is a high-precision component designed to fail with the application of a predetermined hydraulic pressure. Typically, the frangible disk member 105 is a rupture disk or a diaphragm. Rupture disks are commonly used in downhole applications in which the controlled application of pump pressure is used to set or operate downhole equipment. In the present invention, the frangible disk member is used as a protection device to prevent pressurization of the tool 200. In doing so the frangible disk member 105 allows fluid communication between the upper bore 145 and the lower bore 175 when the frangible disk member 105 fails due to a pressure above the predetermined hydraulic pressure.

The tool 200 further includes a valve stem 130 connected to the valve member 100. As shown, an arm 135 and a handle 155 are connected to the valve stem 130 on the exterior of the tool 200. The handle 155 is constructed and arranged of weighted material to open the valve member 100 only when the tool 200 is inserted into casing and to close the valve member 100 after the tool 200 is removed from the casing. The handle 155 is weighted such that upon removal from the casing, gravity causes the handle 155 and arm 135 to rotate downward, thereby providing rotational torque to close the valve member 100. In this manner the handle 155, arm 135 and valve stem 130 act as a unit to cause the valve member 100 to move between the open and closed position during operation of the tool 200.

Figure 4:
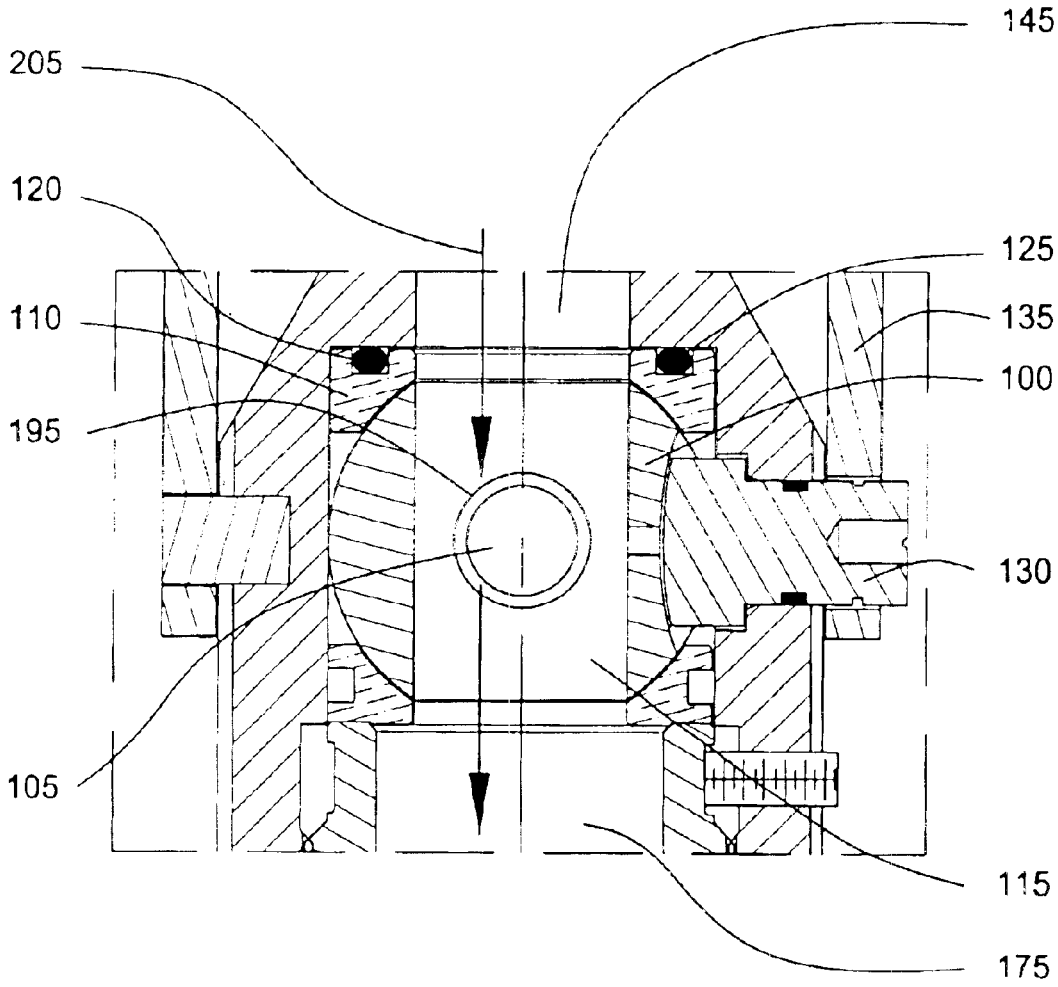
FIG. 4 is an enlarged view of the valve member in an open position.

FIG. 4 is an enlarged view of the valve member 100 in the open position. As shown, the valve bore 115 in the valve member 100 is aligned with the upper bore 145 and the lower bore 175. As illustrated by arrow 205, fluid from the mud pump is permitted to flow down the upper bore 145, through the valve bore 115 and into the lower bore 175. As further shown, the first and second seal members 120, 125 on the valve body 110 prevent any fluid from entering around the valve body 110. Also clearly shown is the frangible disk member 105 disposed in the lateral bore 195. It should be noted that the valve member 100 in the open position does not expose frangible disk member 105 to the flow of fluid through the valve bore 115.

Figure 5:
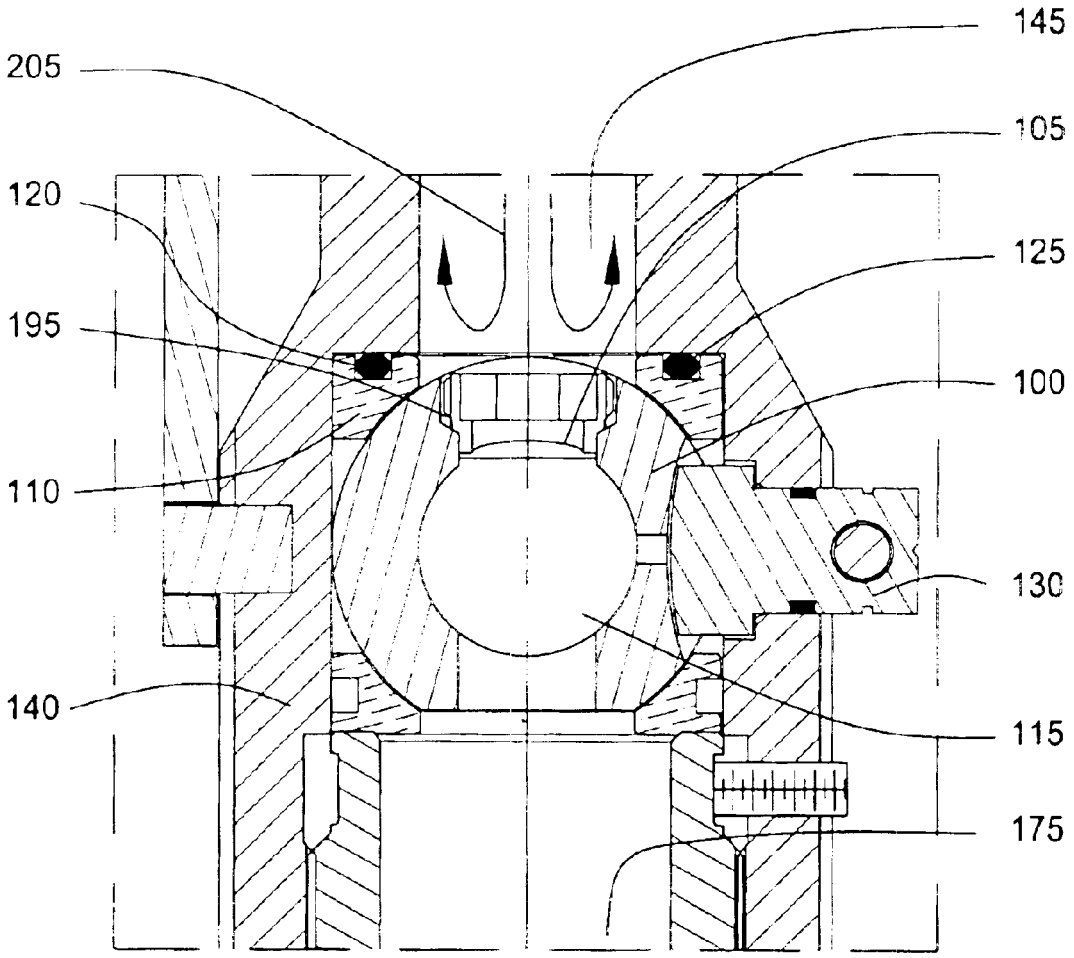
FIG. 5 illustrates an enlarged view of the valve member in a closed position.

FIG. 5 illustrates a view of the valve member 100 in the closed position. As depicted, the valve member 100 has rotated approximately 90 degrees to the closed position. The valve bore 115 is no longer aligned with the upper bore 145 and the lower bore 175. Instead, the lateral bore 195 is aligned with the upper bore 145 and lower bore 175, thereby exposing the frangible disk member 105 to the fluid in the upper bore 145. As illustrated by the flow arrow 205, the fluid in the upper bore 145 is prevented from entering the lower bore 175. In addition, the sealing relationship between the valve body 110 and the upper body 140 prevents any leakage around the first and second seal members 120, 125.

Typically, the mud pump will be turned off prior to moving the valve member 100 to the closed position as shown on FIG. 5. The excess fluid in the hose connecting the mud pump to the tool 200 will either stay in the hose or flow to the tool 200. Fluid in the tool 200 will usually be at a low pressure because there is no additional fluid pressure from mud pump. In this respect, the hydraulic pressure acting against the frangible disk member 105 is below the predetermined hydraulic pressure, thereby allowing the frangible disk member 105 to act as a barrier to fluid communication into the lower bore 175. Therefore, fluid will collect in the upper bore 145 and remain there until the valve member 100 is opened. At that time, the valve bore 115 will align with the upper bore 145, thereby allowing the fluid to be communicated to the lower bore 175.

However, if the valve member 100 is intentionally or accidentally closed while a volume of mud in the hose continues to be communicated to the tool 200, a pressure build up will occur in the upper bore 145. As more fluid enters the upper bore 145, the hydraulic pressure acting against the frangible disk member 105 will increase. At a predetermined hydraulic pressure, the frangible disk member 105 is caused to fail, thereby allowing fluid to enter the lower bore 175 as illustrated in FIG. 6.

Figure 6:
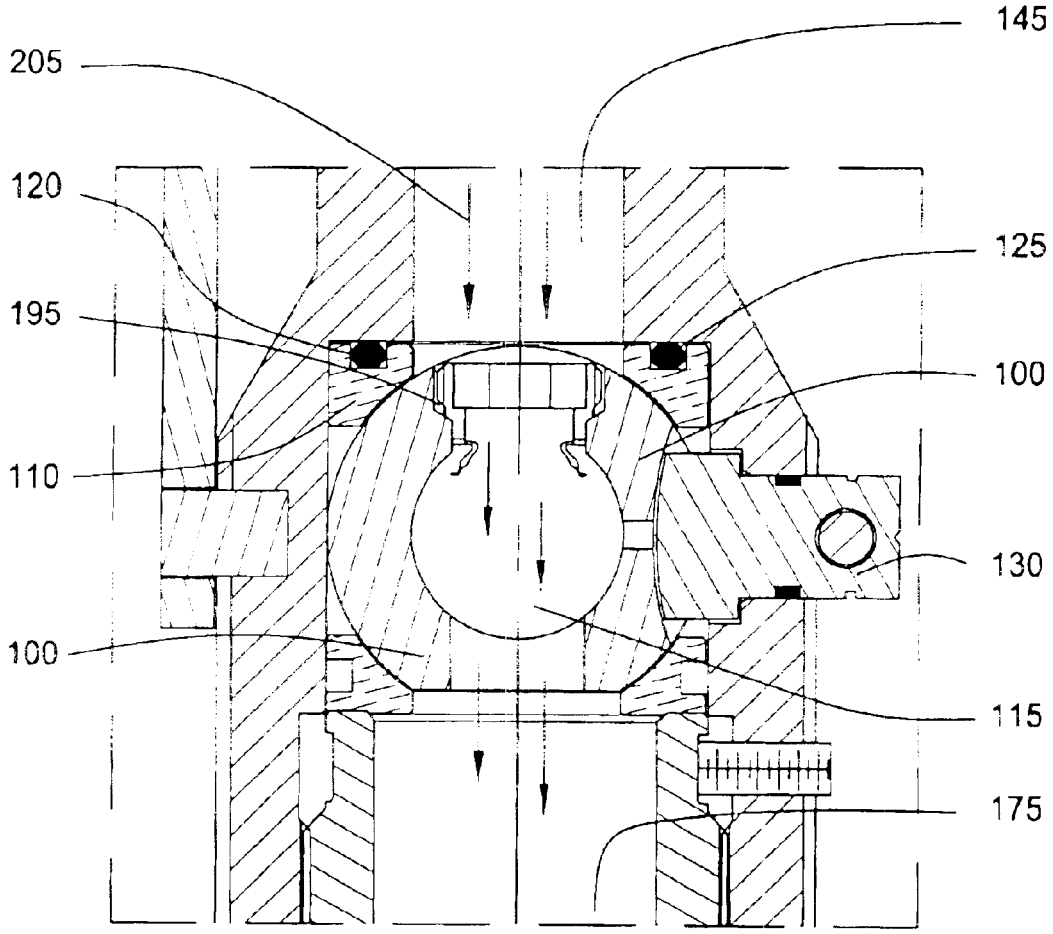
FIG. 6 illustrates a view of the valve member after the frangible disk member fails.

FIG. 6 illustrates a view of the valve member 100 after the frangible disk member 105 fails. As shown, the frangible disk member 105 is no longer disposed within the lateral bore 195 but rather is destroyed, thereby removing the barrier between the upper bore 145 and the lower bore 175. As illustrated by arrow 205, the pressurized fluid inside the upper bore 145 is allowed to flow through the lateral bore 195 into the lower bore 175 exiting the tool 200 through port 185. In this manner, the pressure in the upper bore 145 of the tool 200 may be relieved to prevent damage to the hose or the mud pump.

According to another important aspect of the present invention, the destroyed frangible disk member 105 may be replaced without replacing the valve member 100. In this respect, the valve member 100 may be removed from the valve body 110 to permit the replacement of the frangible disk member 105. The destroyed frangible disk member 105 is removed and a new frangible disk member 105 is disposed in lateral bore 195. Thereafter, the original valve member 100 and the new frangible disk member 105 are placed back into the valve body 110. In this manner, the tool 200 may be quickly put back into operation to continue to fill and circulate mud through the casing string.

In operation, the tool 200 is inserted into a string of casing. Upon installation, the handle 155 is caused to contact the string of casing and move the valve member 100 from the closed position to the open position. Thereafter, the mud pump is turned on to introduce fluid into the tool 200 to fill the casing with mud. The fluid flows down the upper bore 145, through the valve bore 115 and the lower bore 175, thereafter exiting out port 185. After the casing is filled, the mud pump is turned off and the tool 200 is removed from the casing. Upon removal of the tool 200, gravity causes the weighted handle 155 to rotate downward, thereby returning the valve member 100 to the closed position.

In the event that the tool 200 is removed from the casing prematurely, the valve member 100 will close. At this point, fluid will gather in the upper bore 145. As more fluid enters the upper bore 145, the hydraulic pressure acting against the frangible disk member 105 will increase. At a predetermined hydraulic pressure, the frangible disk member 105 is caused to fail, thereby allowing fluid to flow through the lateral bore 195. Thereafter, the pressurized fluid inside the upper bore 145 is permitted to flow through the lateral bore 195 into the lower bore 175 exiting the tool 200 through port 185. In this manner, the pressure in the upper bore 145 of the tool 200 may be relieved to prevent damage to the hose or the mud pump.

While the foregoing is directed to embodiments of the present invention, other and further embodiments of the invention may be devised without departing from the basic scope thereof, and the scope thereof is determined by the claims that follow.

What is claimed is:

1. A valve for use in an oilfield tool, the valve comprising:

a valve body;

a valve member disposed in the valve body, wherein the valve member is movable to an open position when the valve is inserted in a wellbore tubular and to a closed position when the valve is removed from the tubular;

an aperture formed in the valve member, the aperture providing fluid communication through the valve in the closed position; and a pressure relief member disposed in the aperture, the pressure relief member preventing fluid communication through the valve in the closed position, whereby at a predetermined pressure the pressure relief member permits fluid communication.

2. The valve of claim 1, wherein the valve member further includes a longitudinal bore therethrough providing fluid communication through he valve in the open position.

3. The valve of claim 2, further including a rotational member attached to the valve member to rotate the valve member in the valve body.

4. The valve of claim 3, wherein the rotational member causes the valve member to rotate between the open and closed position, whereby in the open position the longitudinal bore aligns with a passageway and in the closed position the aperture aligns with the passageway.

5. The valve of claim 1, further including a first and a second seal member disposed at the upper end of the valve body.

6. The valve of claim 1, wherein the valve member in the closed position exposes the pressure relief member to a fluid pressure.

7. The valve of claim 6, wherein at the predetermined pressure the pressure relief member opens, thereby allowing fluid communication through the valve.

8. The valve of claim 1, wherein the valve member is ball valve.

9. An apparatus to introduce fluid into a casing, the apparatus comprising:

a body having a bore therethrough; and a valve disposed in the body for selectively controlling a fluid flow through the bore, the valve comprising:

a valve member movable between an open position when the apparatus is inserted into the casing and a closed position when the apparatus is removed from the casing, the valve member including an aperture for providing selective communication through the valve in the closed position, and a pressure relief member disposed in the aperture, whereby at a predetermined pressure the pressure relief member permits fluid communication.

10. The apparatus of claim 9, wherein the valve further includes a rotational member attached to the valve member to rotate the valve member between the open and closed position.

11. The apparatus of claim 10, wherein the rotational member causes the valve member to rotate to the open position when the apparatus is inserted in the casing and to the closed position when the apparatus is removed from the casing.

12. The apparatus of claim 11, wherein the valve member further includes a longitudinal bore therethrough for providing fluid communication through the bore in the open position.

13. The apparatus of claim 12, wherein the valve member in the closed position aligns the aperture with the bore, thereby exposing the pressure relief member to the fluid.

14. The apparatus of claim 13, wherein the predetermined pressure causes the pressure relief member to open, thereby permitting fluid communication through the bore.

15. The apparatus of claim 9, wherein the valve member is a ball valve.

16. A method of introducing fluid into a tubular, comprising;

locating an apparatus in the tubular, the apparatus comprising:

a body having a bore therethrough; and a valve disposed in the body for selectively controlling a flow fluid through the bore, the valve including a valve member and a pressure relief member disposed in the valve member, wherein at a predetermined pressure the pressure relief member opens;

opening the valve in the apparatus upon insertion into the tubular;

pumping fluid through the apparatus;

introducing fluid into the tubular;

removing the apparatus from the tubular; and closing the valve and exposing the pressure relief member to fluid.

17. The method of claim 16, wherein the valve member is movable between an open and a closed position.

18. The method of claim 17, wherein opening the valve allows fluid communication through the bore of the apparatus.

19. The method of claim 18, wherein the predetermined pressure causes the pressure relief member to permit fluid communication through the bore.

20. An apparatus to introduce fluid into a casing, the apparatus comprising:

a body having a bore therethrough; and a valve disposed in the body for selectively controlling a fluid flow through the bore, the valve comprising:

a valve member movable between an open and a closed position, the valve member includes a longitudinal bore therethrough for providing fluid communication through the bore in the open position and an aperture for providing selective communication through the bore in the closed position;

a pressure relief member disposed in the aperture, whereby at a predetermined pressure the pressure relief member will permit fluid communication through the bore; and a rotational member attached to the valve member to rotate the valve member to the open position when the apparatus is inserted into the casing and to the closed position when the apparatus is removed from the casing.

21. A method of introducing fluid into to a tubular, comprising;

locating an apparatus in the tubular, the apparatus comprising:

a body having a bore therethrough; and a valve disposed in the body for selectively controlling a flow fluid through the bore, the valve including a valve member movable between an open and a closed position and a pressure relief member disposed in the valve member;

opening the valve to allow fluid communication through the bore of the apparatus:

pumping fluid through the apparatus;

introducing fluid into the tubular;

removing the apparatus from the tubular; and closing the valve member and allowing fluid to contact the pressure relief member, wherein a predetermined pressure causes the pressure relief member to permit fluid communication through the bore.

* * * * *